US012663238B2

(12) United States Patent
Weiszl

(10) Patent No.: US 12,663,238 B2
(45) Date of Patent: Jun. 23, 2026

(54) ADJUSTMENT TURRET FOR A RIFLESCOPE

(71) Applicant: Swarovski-Optik AG & Co KG., Absam (AT)

(72) Inventor: Gunther Weiszl, Moellersdorf (AT)

(73) Assignee: Swarovski-Optik AG & Co KG, Absam (AT)

( * ) Notice: Subject to any disclaimer, the term of this patent is extended or adjusted under 35 U.S.C. 154(b) by 36 days.

(21) Appl. No.: 18/926,406

(22) Filed: Oct. 25, 2024

(65) Prior Publication Data

US 2025/0244103 A1 Jul. 31, 2025

Related U.S. Application Data

(60) Provisional application No. 63/625,466, filed on Jan. 26, 2024.

(51) Int. Cl.
*F41G 1/16* (2006.01)
*F41G 11/00* (2006.01)

(52) U.S. Cl.
CPC ..... *F41G 1/16* (2013.01); *F41G 11/001* (2013.01)

(58) Field of Classification Search
CPC . F41G 1/16; F41G 1/38; F41G 11/001; G02B 23/16; G02B 23/14
See application file for complete search history.

(56) References Cited

U.S. PATENT DOCUMENTS

| | | | | |
|---|---|---|---|---|
| 10,788,288 | B2 * | 9/2020 | Lin | G02B 23/14 |
| 10,900,747 | B2 * | 1/2021 | Kilic | F41G 1/46 |
| 2013/0276345 | A1 * | 10/2013 | Hamilton | G02B 23/16 42/119 |
| 2016/0040959 | A1 * | 2/2016 | Davidson | F41G 1/38 42/122 |
| 2016/0146576 | A1 * | 5/2016 | White | F41G 3/02 42/119 |
| 2018/0180383 | A1 * | 6/2018 | Lin | G02B 7/023 |
| 2018/0347945 | A1 * | 12/2018 | Burianec | F41G 1/42 |
| 2019/0072363 | A1 * | 3/2019 | Kilic | F41G 1/46 |
| 2019/0128644 | A1 * | 5/2019 | Tang | F41G 1/545 |
| 2022/0090879 | A1 * | 3/2022 | Walker | F41G 1/545 |
| 2022/0244521 | A1 * | 8/2022 | Liang | G02B 23/16 |
| 2022/0373296 | A1 * | 11/2022 | Cheng | F41G 1/16 |

* cited by examiner

*Primary Examiner* — Joshua E Freeman
(74) *Attorney, Agent, or Firm* — Collard & Roe, P.C.

(57) ABSTRACT

An adjustment turret for a riflescope has a base socket for mounting on the riflescope; and an adjusting ring which is rotatable about an axis of rotation relative to the base socket in a first rotation direction and in an opposite second rotation direction. An actuation element arranged between the adjusting ring and the base socket is adjustable from a first position to a second position by the rotation of the adjusting ring in the first rotation direction, and is adjustable from the second position to the first position in case of rotation of the adjusting ring in the second rotation direction. By the actuation element, in its first position, a first end stop for the rotation in the second rotation direction is formed, and, in its second position, a second end stop for the rotation in the first rotation direction is formed.

17 Claims, 6 Drawing Sheets

ADJUSTMENT TURRET FOR A RIFLESCOPE

CROSS REFERENCE TO RELATED APPLICATIONS

This application is a non-provisional application that hereby claims priority under 35 U.S.C. 119 (e) from U.S. Provisional Patent Application Ser. No. 63/625,466 filed Jan. 26, 2024, the disclosure of which is incorporated herein by reference.

BACKGROUND OF THE INVENTION

1. Field of the Invention

The invention relates to an adjustment turret for a long-range optical device, in particular a riflescope with a base socket for mounting on the riflescope, and to an adjusting ring which adjusting ring is rotatable about an axis of rotation relative to the base socket in a first direction of rotation and in an opposite second direction of rotation, wherein an actuator element (for adjusting the long-range optical device) can be actuated by means of the rotation of the adjusting ring.

2. Description of the Related Art

Such adjustment turrets are known from the prior art and are widely used. They serve to adjust an angular or axial position of individual components of a long-range optical device, wherein a respective rotational position of the adjustment turrets causes a respective angular and/or axial position of the components. In this respect, adjusting screws or other rotatable elements, which are adjustable axially or radially, for example, are coupled as actuators with the rotation of the adjusting ring.

The adjustment turrets of the prior art usually have an almost complete rotation between two end stops, which are divided into individual clicks and/or angular positions of the turret.

A disadvantage of such adjustment turrets is that they are often not sufficiently configured with regard to their permissible rotation to utilize the maximum possible adjustment range, so that the associated limited adjustment is also insufficient.

SUMMARY OF THE INVENTION

The object of the present invention was to overcome the shortcomings of the prior art and to provide an adjustment turret by means of which a user is able to enable a larger adjustment range.

This object is achieved by an adjustment turret according to the invention.

The device according to the invention is characterized in that an actuation element is arranged between the adjusting ring and the base socket, wherein the actuation element is adjustable from a first position to a second position by means of the rotation of the adjusting ring in the first direction of rotation, and is adjustable from the second position to the first position when the adjusting ring is rotated in the second direction of rotation, and that, by means of the actuation element in its first position, a first end stop for the rotation of the adjusting ring by a predetermined amount in the second direction of rotation is formed and, by means of the actuation element in its second position, a second end stop for the rotation of the adjusting ring by a predetermined amount in the first direction of rotation is formed.

By means of the embodiment according to the invention, it is possible to create an adapted adjustment turret which, due to the geometry of the adjusting ring and the base socket interacting with an actuation element, can provide more than a single rotation, in particular additionally approximately one rotation, with an additional number of individual rotational positions for an adjustment turret. In this regard, the actuation element, which is arranged in the form of a selector switch between the adjusting ring and the base socket, has two end positions, which define a first and second end of the rotational movement of the adjusting ring. The respective permissible angular amounts of the rotational movements between the end stops are determined by the geometric design of the adjusting ring and the base socket in combination with the actuation element. In this way, larger adjustment travels can be achieved by simple means using an adjustment turret (with nevertheless) hard stops.

At this point, it should be noted that the basic idea of the invention is not limited to an exact adjustment by certain rotations, but rather to the enlargement of an adjustment range made possible by this.

During a respective adjustment of the actuation element into the first or second position in a respective direction of rotation, the actuation element can be exceeded at least once with respect to the relative movement of the adjusting ring in relation to the base socket after its adjustment by the adjusting ring in the current direction of rotation (e.g. with respect to a theoretical reference point on the adjusting ring), so that the adjusting ring can be rotated by a predetermined amount in the respective direction of rotation until the actuation element is reached again, namely until the further movement in the current direction of rotation is blocked when the actuation element is reached again and an end stop is thus reached. Analogously to this, the adjustment in the other direction of rotation is performed. The respective reset from the end stops takes place in reverse order, wherein first the predetermined amount is traveled in the direction of rotation and then the actuation element is adjusted (to the respective other position).

It should be mentioned that the adjusting movement of the invention can also be used to divide an actuating movement of an actuator element into multiple and thus more precise positions, e.g. in order to adjust a fine thread more precisely.

It is particularly preferred in this regard, that it is provided that more than one rotation, in particular at least two complete rotations of the adjusting ring in the respective direction of rotation, can be performed between the first end stop and the second end stop. In this way, a rotation of the adjusting ring known in the state of the art can be extended from approximately one rotation to a larger adjustment range—e.g. to approximately 2 rotations (and possibly slightly more), thus enabling further adjustment of the adjustment turret or a larger adjustment range.

It may preferably be provided that a neutral position is provided between the first and second position of the actuation element, wherein the actuation element is adjustable from the first position to the neutral position and further to the second position when the adjusting ring is rotated in the first direction of rotation, and is adjustable from the second position to the neutral position and further to the first position when the adjusting ring is rotated in the second direction of rotation.

A preferred embodiment provides for the actuation element to reach the neutral position each time the adjusting ring is rotated by the same amount, starting from a respective end stop, or conversely, starting from the neutral position, the adjusting ring can be rotated by the same amount in each case in the respective direction of rotation up to a respective end stop. A particularly harmonious adjustment is made possible by means of such an embodiment, wherein a respective predetermined amount in the respective direction of rotation is thus the same.

An advantageous embodiment provides for the actuation element to be guided along an arcuate path with respect to its adjustment. This allows the actuation element to be adjusted in a particularly simple and space-saving manner by means of a rotational movement, and/or the distances between the actuation element and the axis of rotation can be adjusted due to the arcuate path.

For example, one leg of the actuation element can be guided along the arcuate path closer to the axis of rotation so that it enables and/or releases a further relative movement of the adjusting ring in relation to the base socket about the axis of rotation. At the same time, another leg of the actuation element can be further distanced from the axis of rotation along the arcuate path so that it forms the end stop and/or inhibits the relative or rotational movement of the adjusting ring with respect to the base socket.

Furthermore, it can be provided in this regard that a center point of the path lies outside the axis of rotation. In this way, the aforementioned adjustment of the actuation element to form the different distances to the axis of rotation can be made possible by simple means.

It can also be provided that the arcuate path is formed on the adjusting ring or on the base socket. When formed on the adjusting ring, the center of the arcuate path can thus be rotated with the adjusting ring about the axis of rotation. When formed on the base socket, this is preferably stationary.

In an advancement, it may be provided that the actuation element has a first actuation surface for the adjustment from the second position to the first position and a second actuation surface for the adjustment from the first position to the second position, wherein the first actuation surface is formed opposite and facing the second actuation surface. Thus, a particularly simple embodiment of the aforementioned adjustments is possible in that the individual actuating surfaces fulfill multiple functions. The first and second actuation surfaces are preferably each formed on one of the aforementioned legs of the actuation element and face each other and can be used both for an adjustment into the respective position and back from the respective other position.

According to a preferred embodiment, it is provided that the actuation element has a first stop surface for forming the first end stop and a second stop surface opposite and facing away from the first stop surface for forming the second end stop. In addition, it is particularly preferred for it to be provided that a first leg of the actuation element has the first stop surface and, opposite thereto, the aforementioned second actuation surface, and that a second leg of the actuation element has the second stop surface and, opposite thereto, the first actuation surface.

Preferably, it can be provided that a first active surface and an opposite second active surface are formed on the adjusting ring or on the base socket, wherein the first active surface is provided for adjusting the actuation element into the first position and interacts with the first end stop, and the second active surface is provided for adjusting the actuation element into the second position and interacts with the second end stop. Furthermore, it is preferred that the active surfaces are provided for actuating the respective actuation surface.

A possible embodiment provides that the actuation element is mounted in the adjusting ring and can be guided with the adjusting ring during rotation about the axis of rotation.

An alternative embodiment provides that the actuation element is mounted in the base socket and can be adjusted with the rotation of the adjusting ring on the base socket.

A particularly preferred embodiment provides that the actuation element has a detent element, wherein the actuation element engages in a complementary detent arrangement on the adjustment turret by means of the detent element during its respective adjustment into the first position and into the second position. By means of such an embodiment, a secure bearing of the actuation element in the respective position can be provided by simple means. The detent element is preferably formed in one piece with the actuation element and is elastically deformable (with respect to the detent).

Preferably, it can be provided that the actuation element is symmetrical with respect to a center plane, wherein the center plane is parallel to the axis of rotation.

It is particularly preferred for it to be provided that a driver is formed on the adjusting ring and that a limiter is formed on the base socket; wherein the actuation element is adjustable between the first and second position during rotation of the adjusting ring by means of the driver and the limiter. The driver is preferably formed and/or shaped as a nose or protruding component on the adjusting ring, which is thus adjustable in accordance with the rotational movement of the adjusting ring. The limiter is preferably an element formed and/or shaped on the base socket, which is stationary relative to the axis of rotation. By means of the relative movement of the driver with respect to the limiter (caused by the rotation of the adjusting ring), the adjustments of the actuation element can be carried out.

An advantageous embodiment provides that the actuation element defines a smallest spacing to the axis of rotation during the respective adjustment to the first or second position, which is smaller than a smallest distance of the adjusting ring or the base socket to the axis of rotation, so that the rotation of the adjusting ring relative to the base socket by means of the actuation element in the current direction of rotation is enabled by the spacing, wherein the respective end stop formed is spaced further apart with respect to the axis of rotation than the smallest distance, so that the rotation is blocked during the rotation in the current direction of rotation by the predetermined amount when the end stop is reached.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 1:
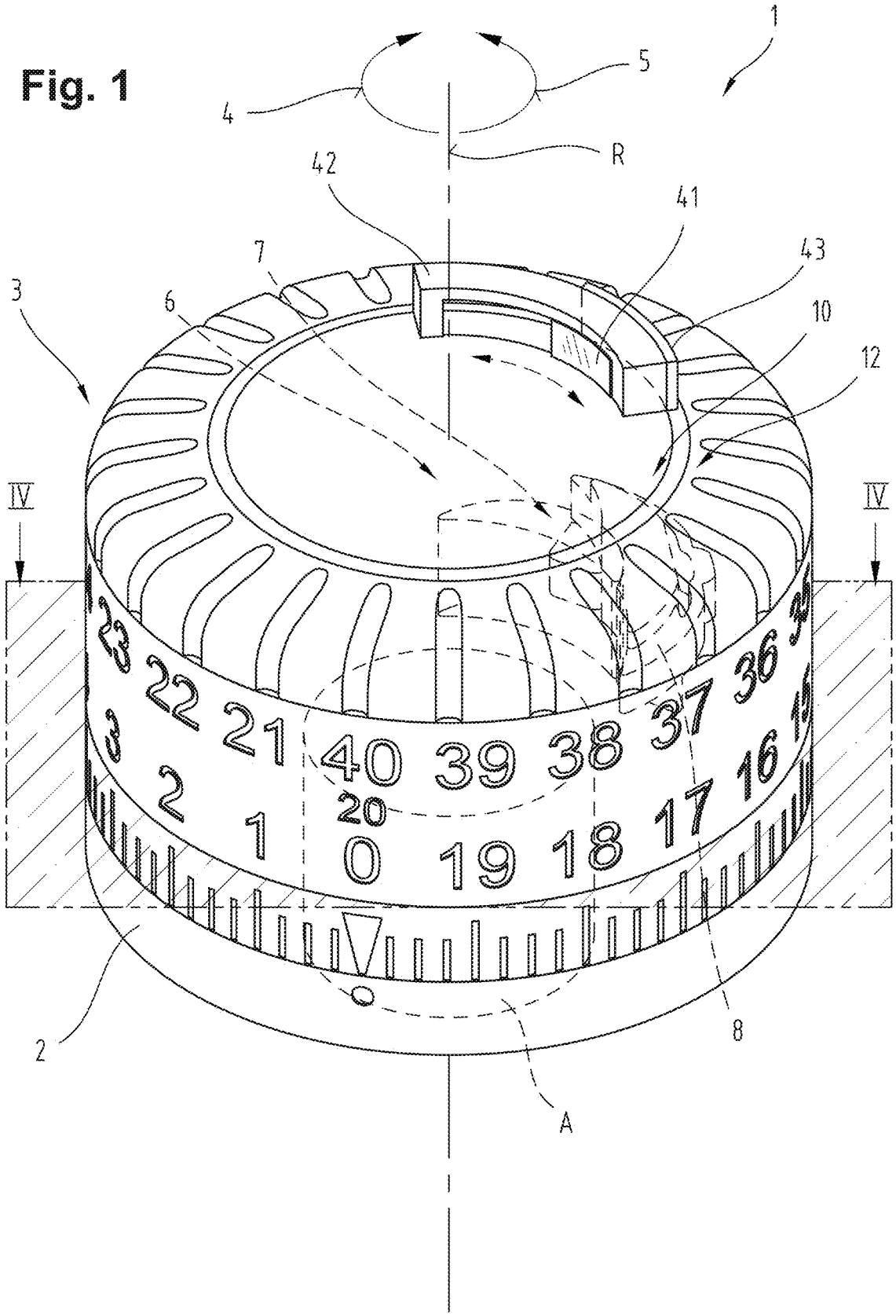
FIG. 1 shows an adjustment turret in an oblique view.

FIG. 1 shows an adjustment turret 1 according to the invention for a long-range optical device, in particular for a riflescope, which has a rotating cap that can be rotated about an axis of rotation R.

The adjustment turret 1 has a base socket 2 for mounting on the long-range optical device. As shown, an adjusting ring 3 can be coupled to the rotating cap.

The adjusting ring 3 can be rotated about an axis of rotation R relative to the base socket 2 in a first direction of rotation 4 and in the opposite direction in a second direction of rotation 5, wherein an actuator element A, which is indicated by a dashed line in FIG. 1, can be actuated by means of the rotation of the adjusting ring 3. The actuator element A can, for example, comprise a spindle or the like, which can be adjusted axially and/or translationally during rotation along the axis of rotation, for example. The actuator element can be used to change a position of an adjustable optical system. With regard to the possible embodiments of an actuator element, reference is made to the prior art.

As can also be seen, the adjustment turret can have a scale which can be assigned to identify a respective rotation and/or rotational position of the adjusting ring 3 between its end stops.

According to the invention, an actuation element 8 is arranged between the adjusting ring 3 and the base socket 2, wherein the actuation element 8 can be adjusted from a first position 10 to a second position in case of rotation of the adjusting ring 3 in the first direction of rotation 4, and/or, against the first direction of rotation 4, can be adjusted back from the second position to the first position 10 in case of rotation in the second direction of rotation 5. As mentioned at the beginning, a neutral position, which preferably forms a middle position between the first and second position with respect to the adjustment, can preferably be provided between the first position 10 and the second position.

With regard to the interaction between the adjusting ring and the base socket for adjusting the actuation element 8, complementary elevations and/or depressions can be formed on the adjusting ring 3 and/or on the base socket 2, which are displaced and/or rotated relative to one another when the adjusting ring 3 is rotated.

Furthermore, the adjustment turret 1 can preferably comprise at least one driver 6 arranged on the adjusting ring 3 and at least one limiter 7 arranged on the base socket 2.

In its first position 10, the actuation element 8 forms a first end stop 12 for the rotation of the adjusting ring 3 by a predetermined amount in the second direction of rotation 5 and in its second position forms a second end stop for the rotation by a predetermined amount in the first direction of rotation 4, so that only a limited rotation in the respective direction of rotation is possible until the respective end stop is reached.

It is particularly preferred that more than one complete rotation of the adjusting ring 3, in particular approximately 2 rotations in the respective direction of rotation 4, 5 can be made between the two end stops until a respective end stop prevents and/or blocks further rotation in the current direction. For a respective rotation, it is preferably provided that the adjusting ring 3 (and/or the driver 6) and the base socket 2 (and/or the limiter 7) can have the same position relative to each other when the end stops are reached.

Figure 4:
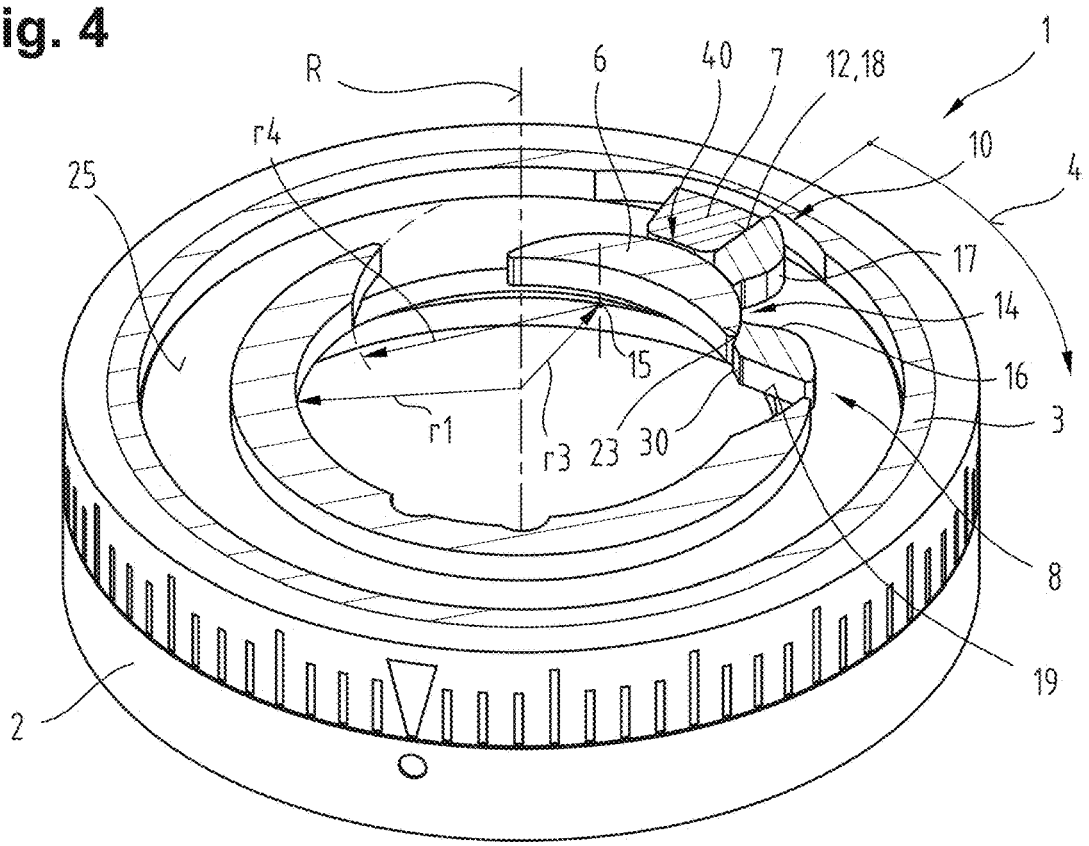
FIG. 4 shows a sectional view of the adjustment turret according to FIG. 1 in an oblique view.

In this respect, FIG. 4 shows the adjustment turret according to FIG. 1 in an oblique and sectional view (according to sectional plane IV-IV). The actuation element 8 is in the first position 10 and forms the first end stop 12, preventing further rotation in the second direction of rotation and thus only allowing rotation in the first direction of rotation 4.

With regard to the respective positions of the actuation element 8, it may also be provided that the adjustment turret 1 has a display device 42, as shown in FIG. 1, in which display device 42 an indicator element 41 is adjustably mounted, wherein the indicator element 41 is coupled to the adjustment movement of the actuation element 8 with regard to the first and second position, so that a respective position on the display device 42 is recognizable (for a user). As can also be seen, the indicator element 41 can be visible both from a side facing the axis of rotation R and from a side facing away from the axis of rotation R. In addition, a cover 43 can be provided by means of which the indicator element 41 can be concealed with respect to at least one of the positions so that, for example, only a selected position of the two positions is visible.

Figure 2B:
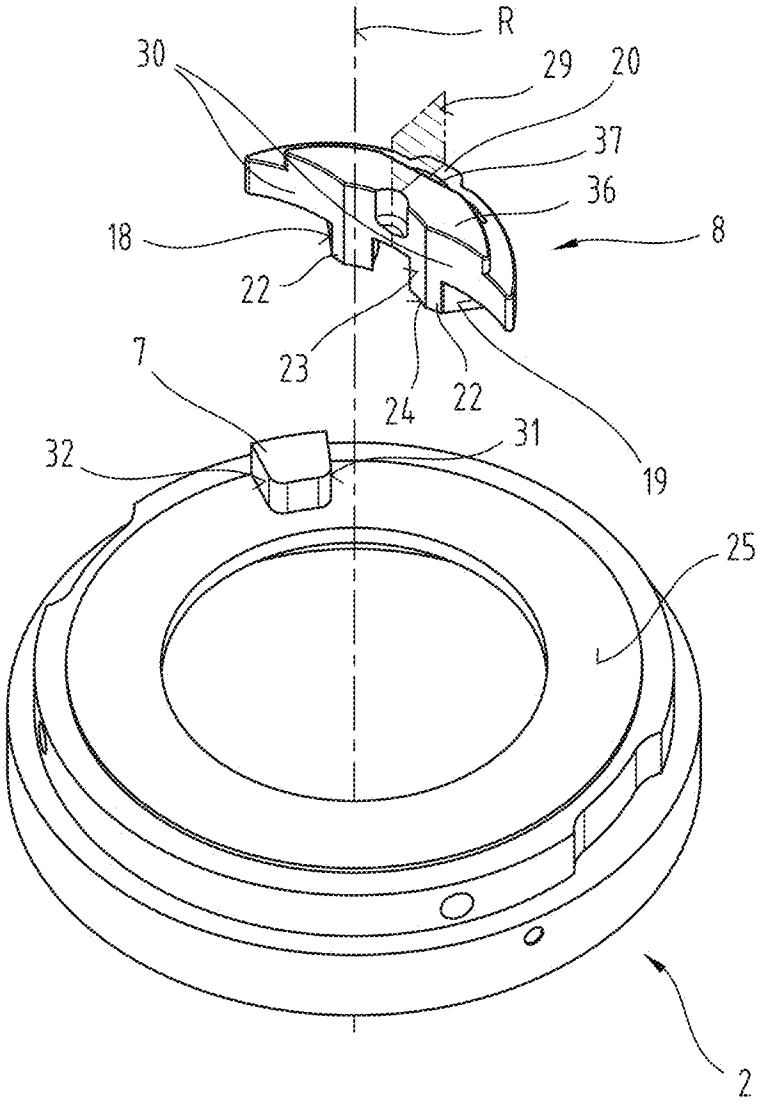
FIGS. 2A and 2B show the adjustment turret according to FIG. 1 in an exploded view.
Figure 2A:
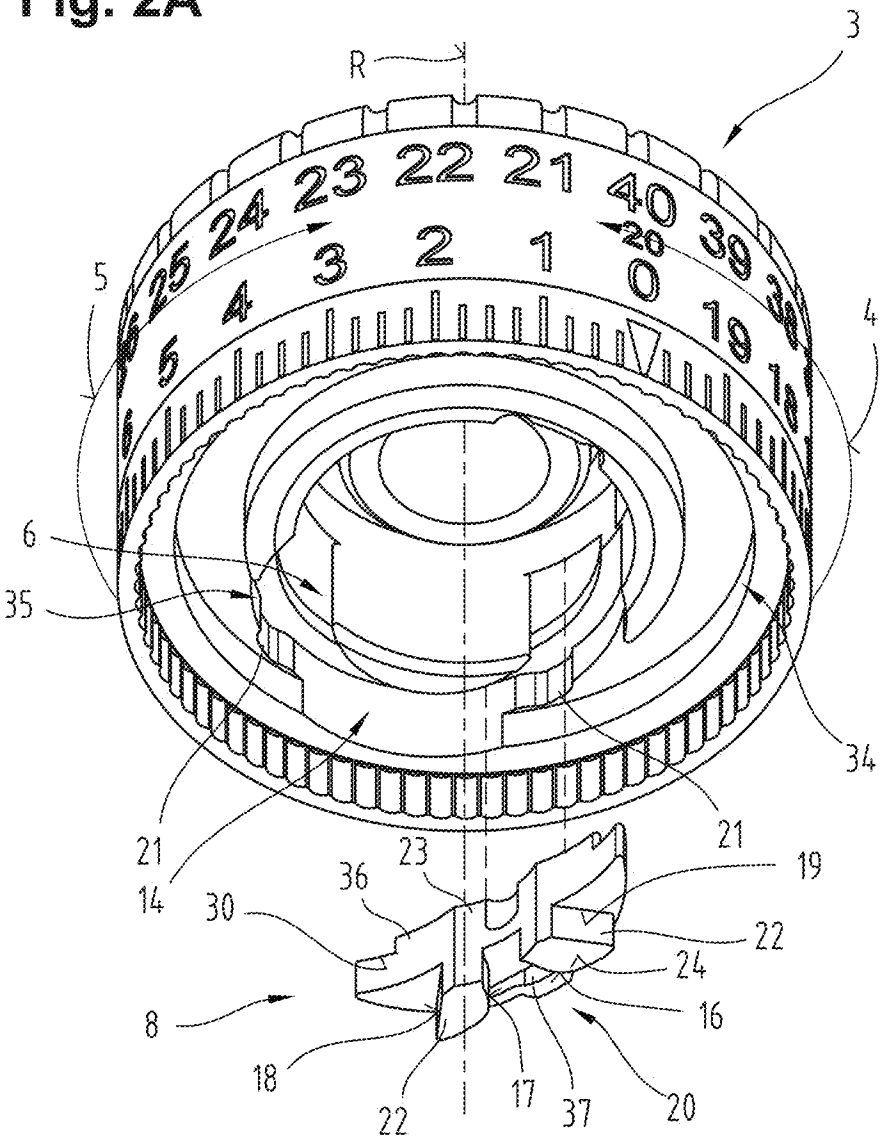

In FIGS. 2A and 2B, the adjustment turret 1 according to FIG. 1 (or FIG. 4) is shown in an exploded view, wherein in the first view FIG. 2A, the movable elements in the form of the adjusting ring 3, the driver 6, and the actuation element 8 are visible from below and in the second view FIG. 2B, the base socket 2 with the limiter 7 is visible in a view from above, wherein the actuation element 8 is shown again and also in a view from above.

Furthermore, as can be seen from FIG. 2A to FIG. 7C, it may be provided that the actuation element 8 is guided along an arcuate path 14 with respect to its adjustment movements (between the first and second positions). In addition, a center point 15 of the path 14 may lie outside the axis of rotation R, so that the adjusting movement has a different path of movement than that of the rotational movement of the adjusting ring 3. Preferably, the center point 15 lies between the axis of rotation R and a region 34 in which the driver 6 and the limiter 7 interact with the actuation element 8.

Preferably, the actuation element 8 comprises a first actuation surface 16 for the transfer into the first position 10 by means of the relative movement of the driver 6 and the limiter 7 with respect to each other, as well as a second actuation surface 17 for the transfer into the second position 11, wherein at the same time the actuation element 8 can be returned from the second position 11 into the neutral position 9 (by means of the relative movement of the driver and the limiter with respect to each other) by means of the first actuation surface 16 and can be returned from the first position 10 into the neutral position 9 by means of the second actuation surface 17.

In FIG. 2B, a center plane 29 is indicated, wherein the actuation element 8 is preferably symmetrical with respect to the center plane 29. In addition, a guide surface 23 is indicated, by means of which guide surface 23 the actuation element can be guided along the arcuate path 14. Thus, the guide surface 23 can preferably have the same curvature as the path 14 and, in an assembled state, the same center point.

Furthermore, the actuation element 8 comprises a first stop surface 18 for forming the first end stop 12 and a second stop surface 19 opposite the first stop surface 18 for forming the second end stop 13. As can also be seen, the two stop surfaces 18, 19 are preferably facing away from each other and offset by an angular amount. It is particularly preferred for these to enclose an angle of less than 90°.

As can also be seen in FIGS. 2A and 2B, the actuation element 8 preferably has two legs 22 projecting in the axial direction, each of which has one of the stop surfaces 18, 19 and forms the end face 24, which end face forms the lower end of the actuation element in the axial direction. Preferably, this involves a first and second leg, which perform the respective tasks described of the actuation element 8 when the actuation element is adjusted and to form the end stops.

Preferably, the actuation element 8 can have a detent element 20 by means of which detent element 20 it engages in a complementary detent arrangement 21 on the adjustment turret 1 during its respective adjustment into the first position 10 and into the second position 11. Depending on the previously mentioned embodiments, the detent arrangement 21 can be formed on the adjusting ring 3 or also on the base socket 2. The detent element 20 can preferably be elastically deformable so that it engages in the detent arrangement 21 without additional means and/or can also be moved out of it again, e.g. by overcoming a slight mechanical resistance by rotating the adjusting ring 3, which mechanical resistance can be detected tactilely. As can be seen in FIGS. 2A and 2B, the detent element can preferably be elastically deformable by means of an aperture 37 in the actuation element 8. In addition, the detent element is preferably an integral part of the actuation element 8 so that no additional components are required for this.

According to FIGS. 2A and 2B, the actuation element 8 can also have a stepped shoulder 36, which is provided for improved guidance of the actuation element and for engagement in a complementary shoulder, for example on the adjusting ring 3.

Furthermore, it may be provided that the actuation element 8 is mounted in the adjusting ring 3 (or in the base socket 2) in such a way that it is basically positively guided between the first and second position and no other movements relative to the adjusting ring (or the base socket) are possible. The actuation element can, for example, be received in a receiving space 35, which is formed in the adjusting ring 3, for example, and/or in the entire adjustment unit.

A sliding surface 25 can be formed on the base socket 2, over which sliding surface 25 the actuation element 8 can be guided, and/or is also axially limited, by means of the end face 24 of the actuation element 8. The limiter 7 preferably extends from the sliding surface 25 in the direction of the axis of rotation R. Preferably, the driver 6 and/or the adjusting ring 3 can also rest on the sliding surface 25. Preferably, in the assembled state of the adjustment turret, the sliding surface 25 forms a lower end of the aforementioned receiving space 35, so that the actuation element 8 is limited by means of these two elements.

Figure 6A:
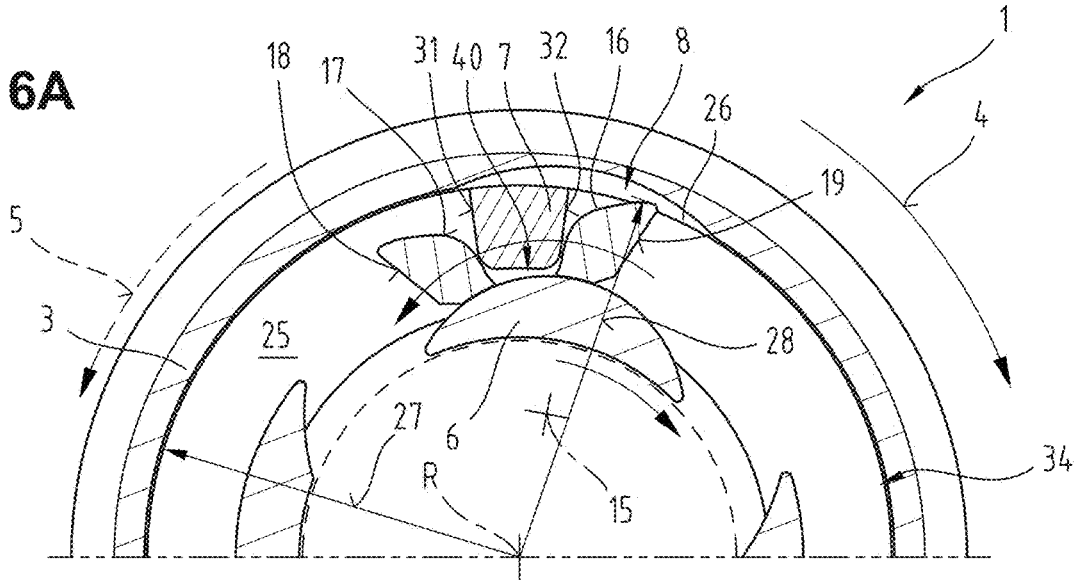
FIGS. 6A, 6B, and 6C show an adjustment of the actuation element according to FIG. 5.
Figure 7A:
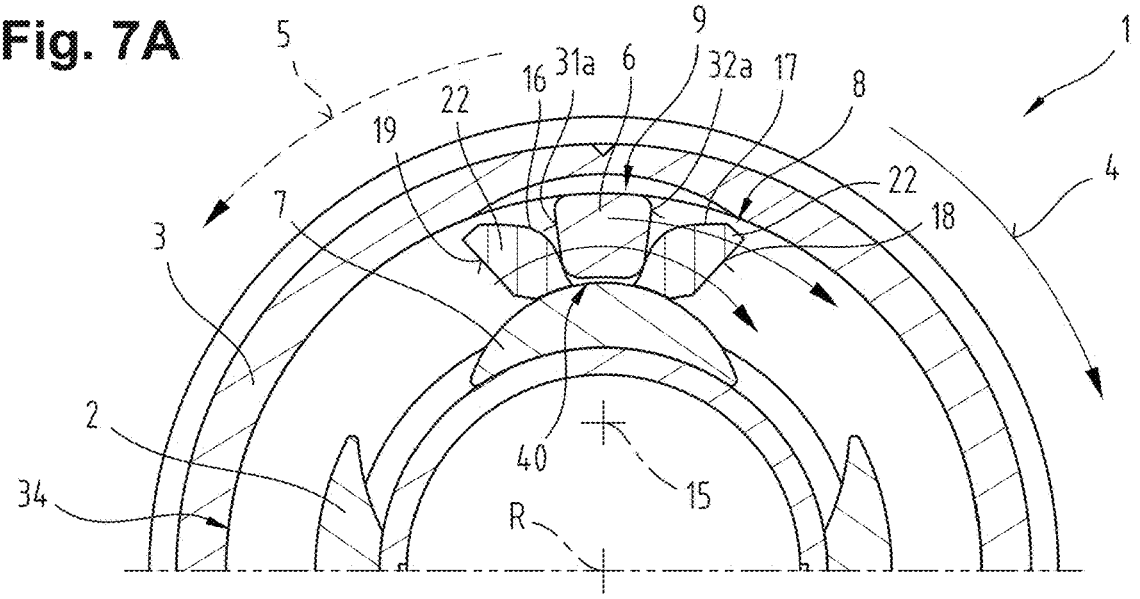
FIGS. 7A, 7B, and 7C show a further embodiment of the adjustment turret.

For the interaction by means of the end stops, a first active surface 31 and an opposite second active surface 32 can be provided on the adjustment turret, wherein the first active surface 31 is provided for adjusting the actuation element 8 into the first position and interacts with the first stop surface 18 with respect to the first end stop 12 and the second active surface 32 is provided for adjusting the actuation element 8 into the second position and interacts with the second stop surface 19 with respect to the second end stop 13. As shown in FIG. 2B and FIG. 6A, the first and second active surfaces 31, 32 can be formed on the limiter 7, or also on the driver 6 as indicated in FIG. 7A with the first active surface 31*a* and the second active surface 32*a*.

As can also be seen from FIGS. 2A and 2B, it is preferably provided that the actuation element 8 has at least one further limiting surface 30, by means of which it is limited on the adjustment turret 1 with respect to its adjustment into the first or second position 10, 11 and a further adjustment in the respective direction is inhibited. The (inhibiting) element interacting with the limiting surface is not shown in more detail, although, as can be seen from the figures, it can also be a cylindrical element with respect to the axis of rotation R, for example, as indicated by a dashed line in FIGS. 4 and 5. It can, for example, be formed by a spindle (in the form of the actuator element).

Figure 3A:
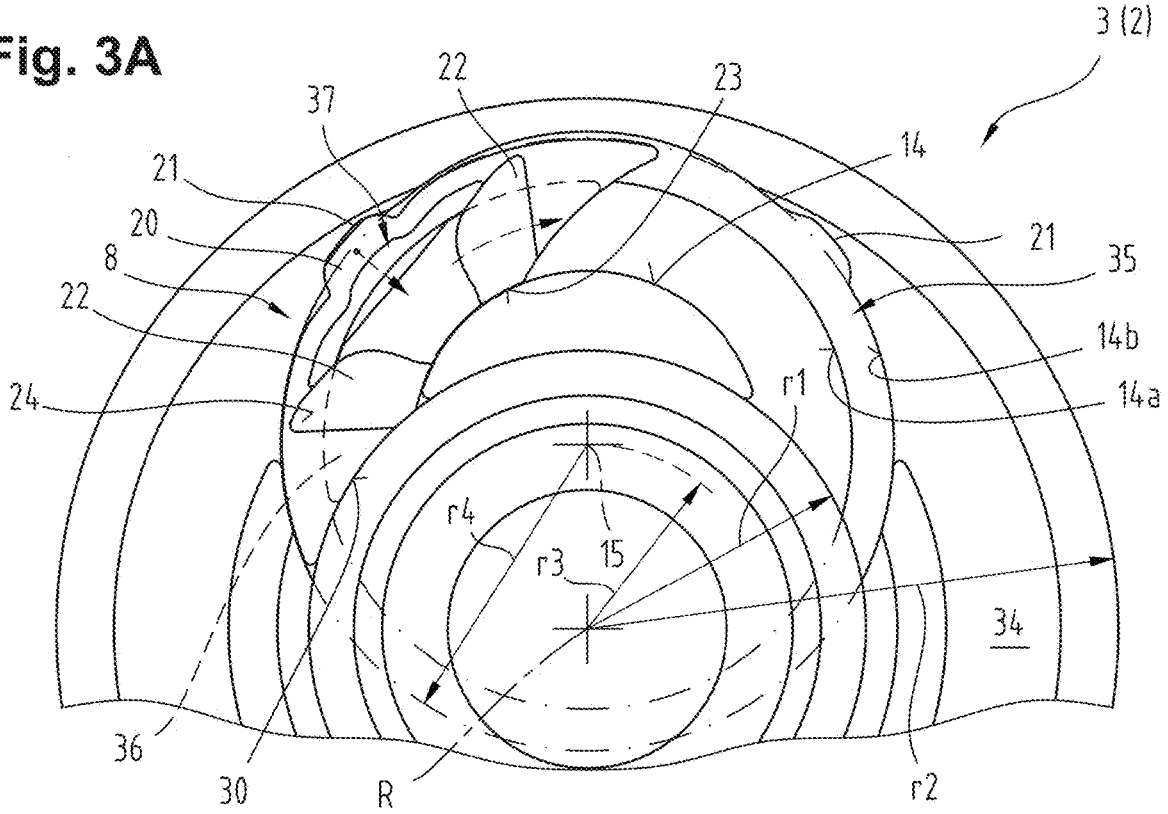
FIGS. 3A and 3B show the inserted actuation element in a view from below.
Figure 3B:
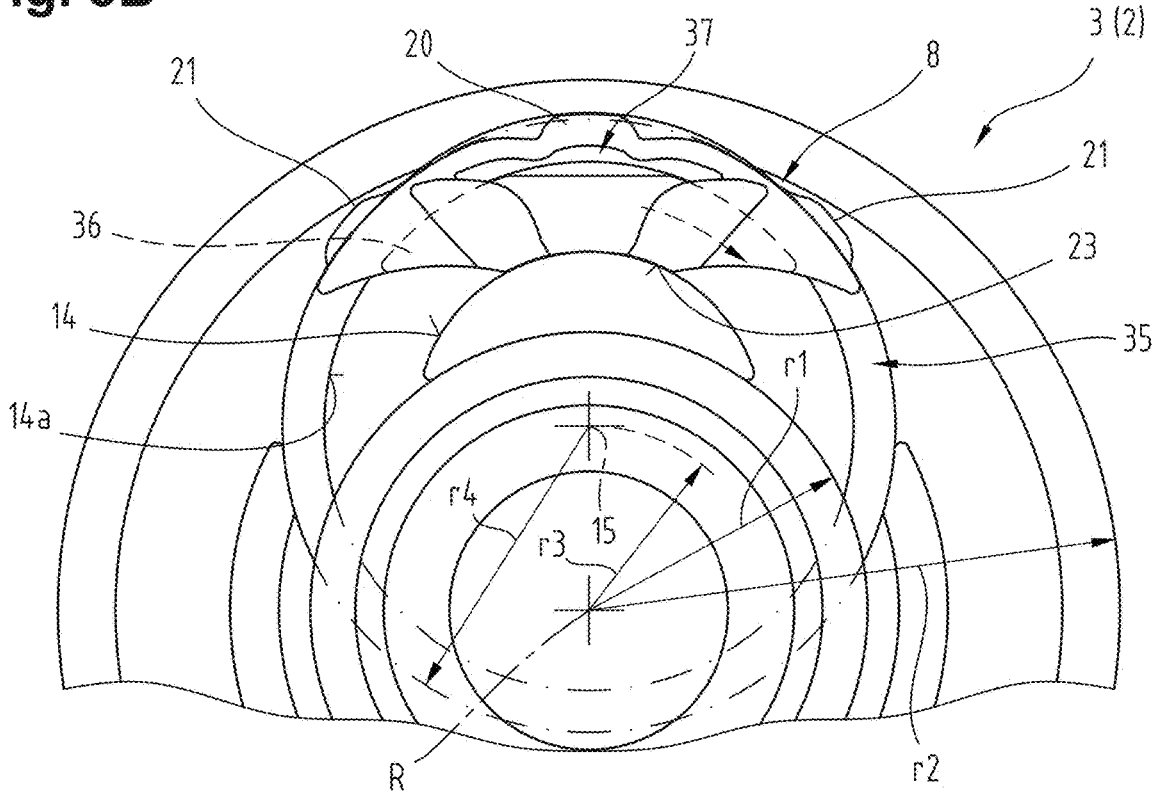

With regard to a spindle or a similar actuator element, a radius r1 is indicated in FIGS. 3A and 3B, which thus indicates the outer dimensions thereof, and/or defines the space within the adjustment turret that is occupied by the actuator element and/or is provided for it. Furthermore, this radius r1 preferably limits the movement of the actuation element 8 with respect to the limiting surface(s) 30.

In FIGS. 3A and 3B, the actuation element 8 according to FIGS. 2A and 2B is shown in the inserted state, in a view from below. In this regard, the actuation element 8 is mounted in the adjusting ring 3, wherein it can also be mounted in the base socket 2, as indicated in brackets.

Furthermore, a radius r2 is indicated, which defines the maximum usable region for the actuation element 8 within the adjusting ring 3 (and/or the adjustment turret 1). The radius r3 defines the spacing of the center point 15 of the arcuate path 14 outside the axis of rotation R from the axis of rotation R, and/or the center point 15 moves along the radius r3 around the axis of rotation R when the adjusting ring rotates (when the actuation element is mounted on the adjusting ring).

As can also be seen, the actuation element lies with the guide surface 23 against the arcuate path 14. The receiving space 35 preferably forms further parts of the arcuate path 14*a*, 14*b* by means of its inner walls, so that a guided movement of the actuation element 8 is made possible by means of these. Thus, as mentioned above, it can have a shoulder for receiving and guiding the step-shaped shoulder 36 of the actuation element 8. Furthermore, the receiving space 35 defines a range of movement for the actuation element 8, preferably at a radius r4 to the center point 15 of the arcuate path 14.

As can also be seen from the previous description, the radii r1 and r4 form an intersection which defines the region in which the actuation element cannot be moved.

In addition, the following geometric conditions of the radii r1-r4 can be derived:

Radius r4 is smaller than the usable range, r2, as the actuation element is arranged radially inside the adjustment turret and r3 is greater than 0, as the center point is preferably outside the axis of rotation R. Radius r3 can preferably be smaller than r1, preferably $r3=\frac{2}{3}*r1$, particularly preferred $0.3<r1/r3<0.9$.

In addition, the deformation of the detent element 20 is shown in FIGS. 3A and 3B with respect to the adjustment of the actuation element 8 from one position to the other position (from the first position in the direction of the second position or vice versa). In FIG. 3A, the detent element 20 is mounted and/or engaged in one of the detent arrangements 21 and is thus in an undeformed state. During adjustment, it is guided by the tapered shape of the recess of the detent arrangement 21, e.g. over a ramp, and is thus elastically deformed in the direction of the aperture 37. According to FIG. 3B, the detent element 20 remains in its elastically deformed state until it is again guided into one of the detent arrangements 21 during adjustment to the first or second position and re-engages there. The adjustment of the detent element 20 can preferably be selected with regard to the resistance in such a way that this is tactilely perceptible.

At this point, it should be mentioned that the adjustment of the actuation element according to the figures preferably takes place along a circular path, wherein the arcuate path 14 can in general also have an elliptical or an uneven curve extension.

FIG. 4 shows the adjusting ring 3 with the actuation element 8 in the neutral position 9. As indicated, it may be provided that in the neutral position 9 the center plane 29 lies in a common line and/or plane with the center of the circle 15 of the arcuate path 14, as well as with the axis of rotation R.

Figure 5:
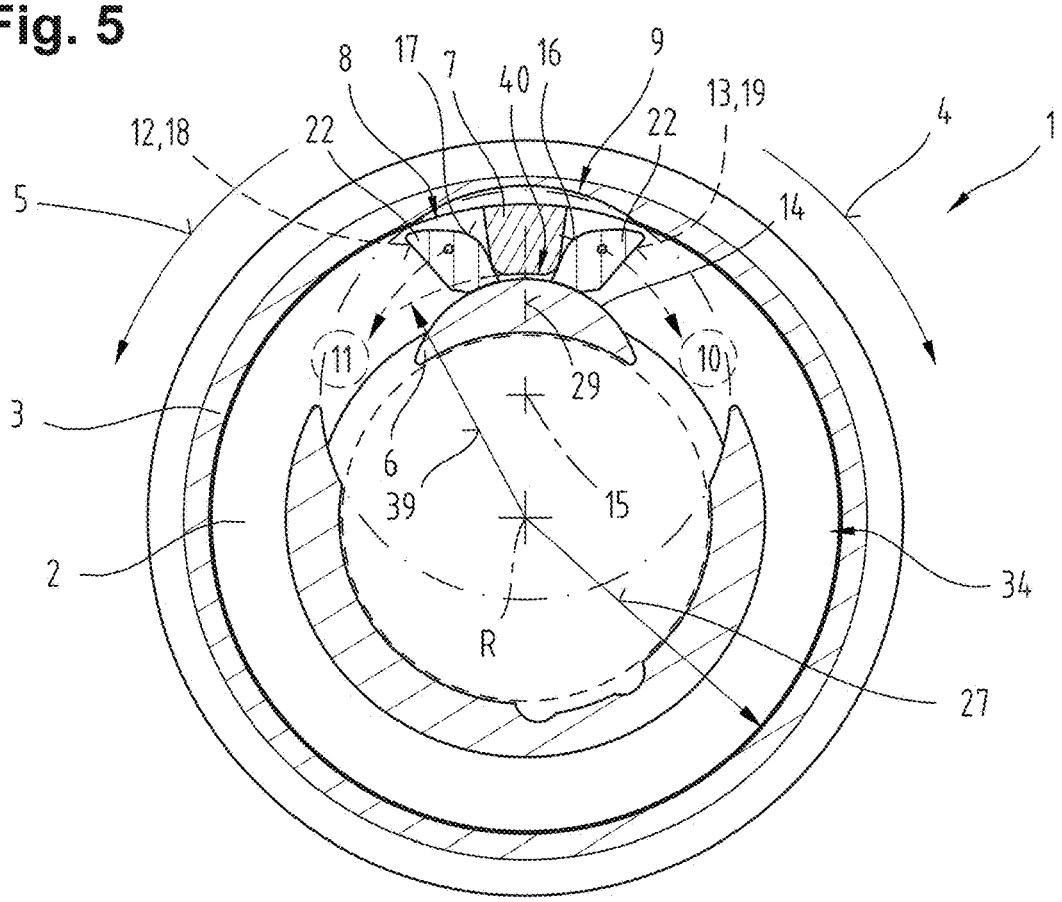
FIG. 5 shows a sectional view with the actuation element in the neutral position.

As can also be seen in FIG. 5, the actuation element can be moved from the neutral position and/or from a state between the first and second positions to its respective positions when the adjusting ring is rotated accordingly. When the adjusting ring 3 is rotated in the first direction of rotation 4, the driver 6 also moves in the first direction of rotation 4, wherein the actuation element 8 is moved into the second position 11 against this direction of movement via the arcuate path 14 by means of the second actuation surface 17 due to the fixed limiter 7. Analogously thereto, when the adjusting ring 3 is rotated in the second direction of rotation 5, the driver 6 also moves in the second direction of rotation 5, wherein the actuation element 8 is adjusted into the first position 10 by means of the first actuation surface 16 due to the fixed limiter 7 counter to this direction of movement.

As can also be seen from FIG. 5 to FIG. 7C, a gap is preferably formed between the adjusting ring 3 (and/or driver 6) and the base socket 2 (and/or limiter 7) (at least between the first and second position), which gap becomes larger when the adjustment is made from the neutral position 9 (due to the arcuate path). The gap 40 defines a smallest distance 39 which can be overcome by means of the actuation element 8 only in the first or second position in the current direction of rotation 4, 5 (which leads to the adjustment into the respective position) by means of one of the two legs 22, so that a further rotation of the adjusting ring can be made up to the respective end stop. In this respect, in each case one of the actuation surfaces 16, 17 and/or legs 22 has a spacing 38 from the axis of rotation R in that region of the actuation element 8 which is closer to the axis of rotation R in the respective first or second position, so that it can be guided through the gap and/or the rotation in the current direction of rotation is enabled and/or it can be guided back via this spacing 38.

As can be seen from FIG. 5, the adjustment turret 1 is preferably configured uniformly with regard to the arrangement of the components for its adjustment movements, and/or symmetrically with regard to a center plane running through the axis of rotation R (in the neutral position) so that a respective adjustment movement from the neutral position in the respective direction of rotation 4, 5 is carried out in the same way or mirrored to each other.

For this reason, the adjustment during rotation in the first direction of rotation 4 is explained below, wherein in the case of rotation in the opposite direction (from the neutral position 9 in the second direction of rotation 5), the individual adjustment processes can be taken from the following explanation (in the opposite direction). At this point, it should be mentioned that the neutral position is preferably only a state of movement of the actuation element between the first and second position, which is not perceptible by a user when the adjusting ring is rotated.

Figure 6B:
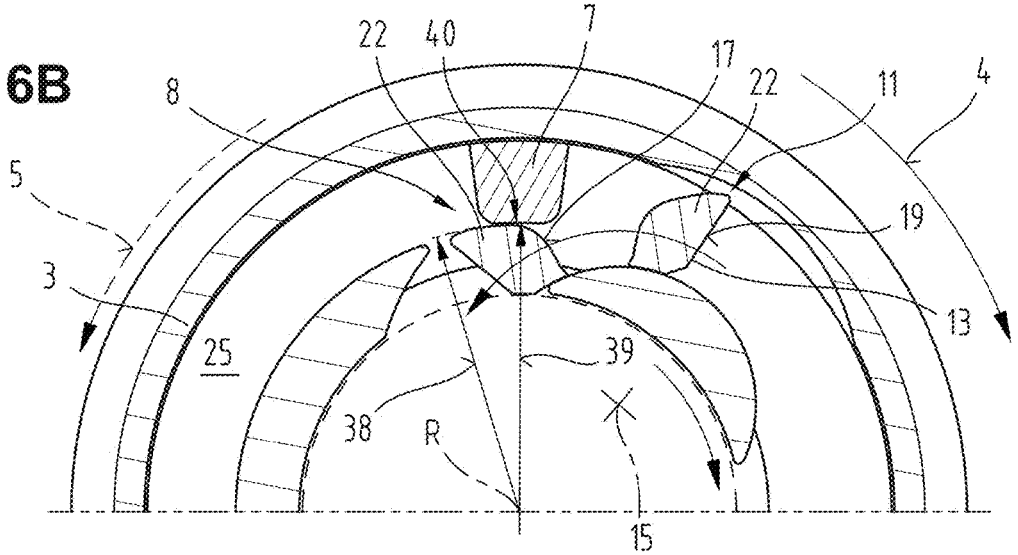
Figure 6C:
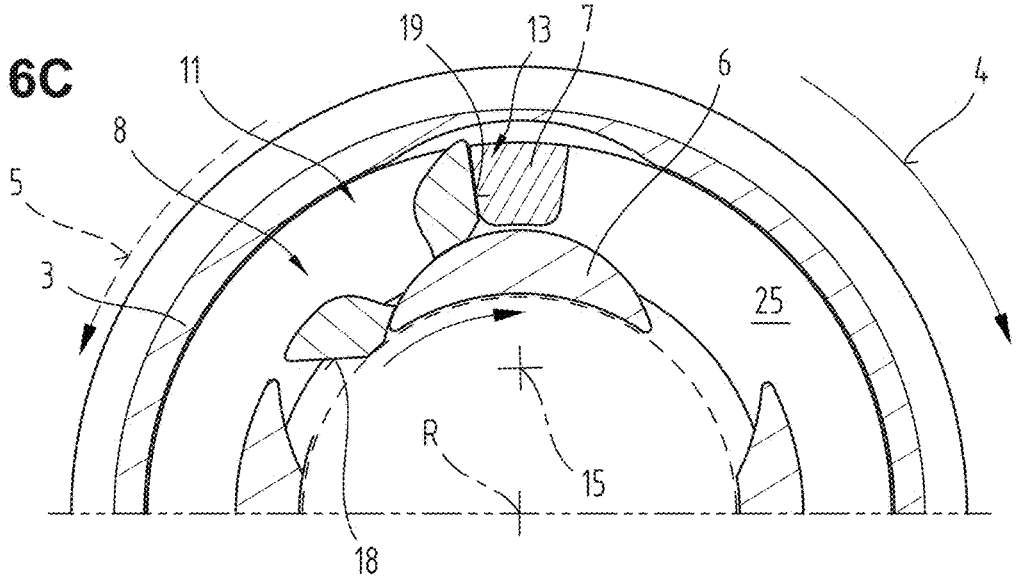

An adjustment from the basic position according to FIG. 5 with a rotation in the first direction of rotation 4 is shown in FIGS. 6A to 6C.

The driver 6 guides the actuation element 8 in the first direction of rotation 4 around the axis of rotation R, wherein the actuation element 8 is positively guided into the second position 11 by means of the limiter 7 against this rotational movement by means of the second actuation surface 17 along the arcuate path 14, as can be seen in FIG. 6A. In this regard, the center point 15 of the arcuate path 14 also moves in the first direction of rotation 4 around the axis of rotation R (corresponding to the rotation of the adjusting ring).

FIG. 6B When the actuation element 8 is moved to the second position 11, it has a spacing 38 and/or radius from the axis of rotation R by means of the second actuation surface 17, which spacing and/or radius allows the actuation element 8 to move past the base socket or limiter 7, whose smallest distance 39 from the axis of rotation R is now equal to or greater than the spacing 38. In this state, the actuation element 8 together with the adjusting ring 3 (and/or the driver) can now be rotated about the axis of rotation R in the first direction of rotation 4 until it contacts the limiter 7 again by means of the second stop surface 19 in the form of the second end stop 13, as can be seen in FIG. 6C. Furthermore, the actuation element 8 rests against the adjustment turret with a previously mentioned limiting surface. Now the actuation element 8 blocks a further rotational movement in the first direction of rotation 4 between the limiter 7 and the adjustment turret, whereby an end position of the adjusting ring is reached.

Analogously to this, the return adjustment from this position against the first direction of rotation, in the second direction of rotation 5, will now be explained. When returning from the second position 11 and/or from the second end stop 13 according to FIG. 6C, the actuation element 8 is moved along in the second direction of rotation 5 when the adjusting ring 3 is rotated, wherein the second actuation surface 17 (and/or the leg 22), due to the second position 11, has that spacing 38 from the axis of rotation R which enables it to be moved past the base socket and/or the limiter (with the distance 39), so that the actuation element 8 is moved along further in the second direction of rotation 5, according to FIG. 6B, until the actuation element 8 contacts/touches the limiter 7 with the first actuation surface 16 according to FIG. 6A and is moved back into the neutral position by means of the rotational movement of the adjusting ring 3 in the second direction of rotation 5 by means of the limiter 7 via the arcuate path 14—against the direction of movement-according to FIG. 5 and can now be moved into the first position 10 with further rotational movement in the second direction of rotation 5.

Furthermore, as can be seen from the adjustment according to FIG. 5 and FIGS. 6A, 6B, and 6C, the dimensioning of the arcuate path 14 and the actuation element 8 can preferably be selected such that the adjusting ring can perform exactly two rotations in the respective direction of rotation between the two end stops (and/or, optionally, one rotation in the respective direction of rotation from the neutral position).

At this point, it should be noted that the possible rotation between the end stops can be changed by means of a geometric adaptation of the adjusting ring 3 (and/or the driver) and the base socket 2 (and/or the limiter 7) and/or the actuation element 8, so that this allows, for example, slightly less than 2 rotations or more than 2 rotations, e.g. (but not limited to) 750° between the two end stops.

Alternatively, the dimensioning of the arcuate path in interaction with the actuation element can also be selected to be wider or shorter, so that, for example, only 1½ revolutions or the like are possible between the two end stops. Furthermore, it can also be provided that the predetermined amounts are unequal with respect to the respective rotational movement so that, for example, the predetermined amount in the first rotational direction is greater than the predetermined amount in the second rotational direction—or vice versa. As mentioned in the beginning, the invention is not limited to an exact adjustment by certain rotations, but rather to the enlargement of an adjustment range made possible by this.

In addition, it may be provided that the actuation element 8 (and/or the leg 22) is dimensioned with respect to its geometric outer dimensions in such a way that, when it is adjusted into the first or second position 10, 11, it exceeds a radius 27 around the axis of rotation R (in the radial direction) and thus has a spacing 28 from the axis of rotation R which is greater than the radius 27 defined by the adjusting ring 3, as indicated in FIG. 6A. In this respect, a recess 26 can be provided which enables movement of the actuation element 8 in this respect.

As can be seen from FIG. 2 to FIG. 6C, according to an embodiment, the actuation element 8 can be mounted and/or received in the adjusting ring 3 and can be guided along with the adjusting ring 3 during rotation about the axis of rotation R.

Figure 7B:
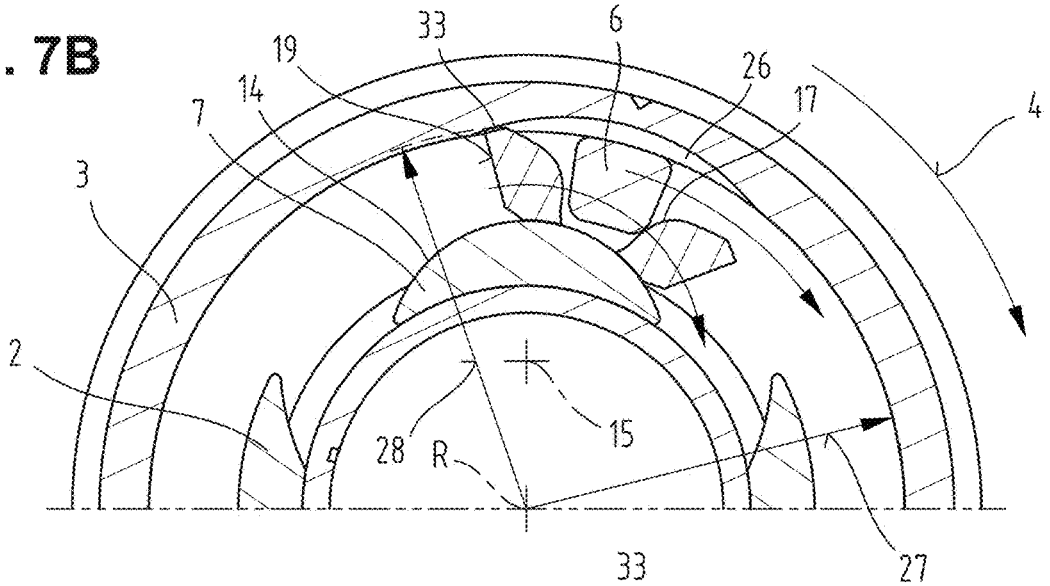
Figure 7C:
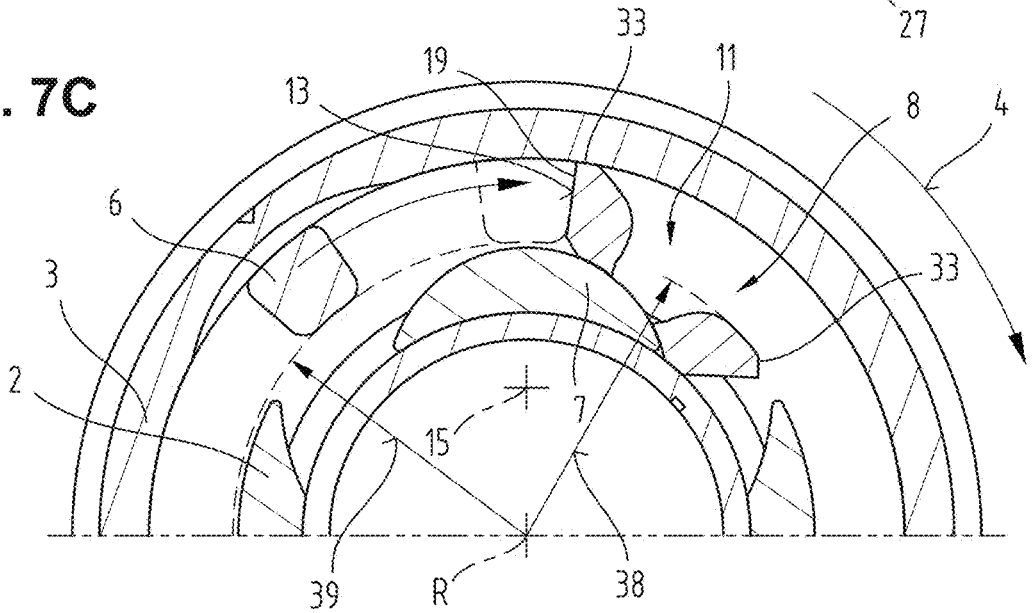

According to a further embodiment, however, the actuation element 8 can also be accommodated in the base socket 2 and be adjustable with the rotation of the adjusting ring 3 on the base socket 2, as can be seen in FIGS. 7A, 7B, and 7C.

In the embodiment shown in FIGS. 7A, 7B, and 7C., the components are basically similar to those shown in FIG. 2 to FIG. 6C, wherein the driver 6 and the limiter 7 are interchanged in terms of their geometric shape.

The limiter 7 comprises the arcuate path 14, which thus forms part of the base socket 2. The driver 6 of the adjusting ring 3 serves to actuate the first and second actuation surfaces 16, 17. The actuation element 8 can basically be configured geometrically as in FIG. 2 to FIG. 6C.

The respective adjustment movements of the actuation element 8 into the first and second positions are now in the same direction with respect to the arcuate path 14 as the rotational movement of the adjusting ring 3, with the result that the first and second positions—as seen in the direction of rotation—are now reversed compared to the embodiment shown in FIG. 5 and FIGS. 6A, 6B, and 6C.

When the adjusting ring 3 is rotated in the first direction of rotation 4, the driver 6 takes the actuation element 8 with it via the second actuation surface 17 in the first direction of rotation 4 according to FIGS. 7A and 7B until it has been moved to the second position 11 according to FIG. 7C. In the second position 11, the second actuation surface 17 has a spacing from the axis of rotation R that allows the driver 6 to pass in the first direction of rotation 4. Starting from the neutral position 9, the driver and/or adjusting ring 3 then performs another complete rotation until the second end stop 13 is reached by the driver 6 striking the second stop surface 19.

As can be seen in FIGS. 7A, 7B, and 7C, the center point 15 in this embodiment is rigid with respect to the axis of rotation R.

Furthermore, in FIGS. 7B and 7C (irrespective of the embodiment), a section 33 is indicated on the actuation element 8 for the respective first and second positions, which section is formed in each case between the stop surfaces 18, 19 and the actuation surfaces 16, 17. The section 33 is dimensioned in such a way that it corresponds to the radius 27 of the hollow cylindrical region (or is slightly smaller) in the first and second position of the actuation element 8 and, when the actuation element 8 is moved from the neutral position 9 to a respective position, in turn defines a spacing 28 which is greater than the radius 27. Thus, according to FIG. 7C, a rotation of the adjusting ring 3 can be enabled, wherein the section 33 blocks an adjustment from the shown second position 11 (and/or analogously in the first position) by resting against an inner circumference of the adjusting ring (or the adjustment turret). Only when the driver 6 passes a recess 26 provided for this purpose, which enables adjustment between the first and second position due to the increased spacing of the recess from the axis of rotation R, is movement of the actuation element 8 enabled by the section 33.

Irrespective of the embodiment, the neutral position 9 is preferably only an intermediate position, which defines a state between the first position and the second position, but which cannot be perceived tactilely from the outside with respect to a resistance or the like during the adjusting movement during the rotation of the adjusting ring 3. Alternatively, it may be provided that the adjusting ring 3 and/or the actuation element 8 is held locked in the neutral position 9 such that it also has a low mechanical resistance or the like.

As is generally apparent from FIG. 2 to FIG. 7C, it is preferably provided that the driver 6 and the limiter 7, as well as the actuation element 8, act together in a hollow cylindrical region 34 between the adjusting ring 3 and the base socket 2. As can also be seen, the driver 6 is preferably movable about the axis of rotation R within this region. The hollow cylindrical region 34 preferably defines the aforementioned radius 27.

FIGS. 7A, 7B, and 7C show a further and possibly independent embodiment of the adjustment turret, wherein again, equal reference numbers and/or component designations are used for equal parts as in the previous figures. In order to avoid unnecessary repetitions, it is pointed to/reference is made to the detailed description of the preceding figures.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

Although only a few embodiments of the present invention have been shown and described, it is to be understood that many changes and modifications may be made thereunto without departing from the spirit and scope of the invention.

LIST OF REFERENCE NUMBERS

1 Adjustment turret
2 Base socket
3 Adjusting ring
4 First direction of rotation
5 Second direction of rotation
6 Driver
7 Limiter
8 Actuation element
9 Neutral position
10 First position
11 Second position
12 First end stop
13 Second end stop
14 Path
15 Center point
16 First actuation surface
17 Second actuation surface
18 First stop surface
19 Second stop surface
20 Detent element
21 Detent arrangement
22 Leg
23 Guide surface
24 End face
25 Sliding surface
26 Recess
27 Radius
28 Distance
29 Central plane
30 Limiting surface
31 First active surface
32 Second active surface
33 Section
34 Region
35 Receiving space
36 Shoulder
37 Aperture
38 Spacing
39 Distance
40 Gap
41 Indicator element
42 Display device
43 Cover
R Axis of rotation
A Actuator element
r1 First radius
r2 Second radius
r3 Third radius
r4 Fourth radius

What is claimed is:

1. An adjustment turret (1) for a riflescope, comprising;

a base socket (2) for mounting on the riflescope;

an adjusting ring (3), wherein the adjusting ring (3) is rotatable about an axis of rotation (R) relative to the base socket (2) in a first direction of rotation (4), as well as in an opposite second direction of rotation (5), wherein an actuator element can be actuated by means of the rotation of the adjusting ring (3);

wherein an actuation element (8) is arranged between the adjusting ring (3) and the base socket (2), wherein the actuation element (8) is adjustable from a first position (10) to a second position (11) by means of the rotation of the adjusting ring (3) in the first direction of rotation (4), and is adjustable from the second position (11) to the first position (10) during the rotation of the adjusting ring (3) in the second direction of rotation (5), and wherein, by means of the actuation element (8), in its first position (10), a first end stop (12) for the rotation of the adjusting ring (3) by a predetermined amount in the second direction of rotation (5) is formed, and, in its second position (11), a second end stop (13) for the rotation of the adjusting ring (3) by a predetermined amount in the first direction of rotation (4) is formed.

2. The adjustment turret (1) according to claim 1, wherein more than one complete rotation of the adjusting ring (3) in the first direction of rotation (4) or in the second direction of rotation (5) can be performed between the first end stop (12) and the second end stop (13).

3. The adjustment turret (1) according to claim 1, wherein a neutral position (9) is provided between the first position and the second position (10, 11) of the actuation element (8), wherein the actuation element (8) is adjustable during rotation in the first direction of rotation (4) from the first position (10) to the neutral position (9) and further to the second position (11), and in the second direction of rotation (5) from the second position (11) to the neutral position (9) and further to the first position (10).

4. The adjustment turret (1) according to claim 3, wherein the actuation element (8) reaches the neutral position (9) each time the adjusting ring (3) is rotated by a selected amount of rotation, starting from a respective end stop (12, 13).

5. The adjustment turret (1) according to claim 1, wherein the actuation element (8) is guided along an arcuate path (14) with respect to its adjustment.

6. The adjustment turret (1) according to claim 5, wherein a center point (15) of the path (14) lies outside the axis of rotation (R).

7. The adjustment turret (1) according to claim 5, wherein the arcuate path (14) is formed on the adjusting ring (3) or on the base socket (2).

8. The adjustment turret (1) according to claim 1, wherein the actuation element (8) has a first actuation surface (16) for the adjustment from the second position (11) to the first position (10), and a second actuation surface (17) for the adjustment from the first position (10) to the second position (11), wherein the first actuation surface (16) is formed opposite the second actuation surface (17) and facing it.

9. The adjustment turret (1) according to claim 1, wherein the actuation element (8) has a first stop surface (18) for forming the first end stop (12) and a second stop surface (19) opposite and facing away from the first stop surface (18) for forming the second end stop (13).

10. The adjustment turret (1) according to claim 1, wherein a first active surface (31) and an opposite second active surface (32) are formed on the adjusting ring (3) or on the base socket (2), wherein the first active surface (31) is provided for adjusting the actuation element (8) into the first position (10) and interacts with the first end stop (12), and the second active surface (32) is provided for adjusting the actuation element (8) into the second position (11) and interacts with the second end stop (13).

11. The adjustment turret (1) according to claim 1, wherein the actuation element (8) is mounted in the adjusting ring (3) and can be guided with the adjusting ring (3) during rotation about the axis of rotation (R).

12. The adjustment turret (1) according to claim 1, wherein the actuation element (8) is mounted in the base socket (2) and can be adjusted with the rotation of the adjusting ring (3) on the base socket (2).

13. The adjustment turret (1) according to claim 1, wherein the actuation element (8) has a detent element (20), wherein the actuation element (8) engages in a complementary detent arrangement (21) on the adjustment turret (1) by means of the detent element (20) during its respective adjustment into the first position (10) and into the second position (11).

14. The adjustment turret (1) according to claim 1, wherein the actuation element (8) is configured symmetrically with respect to a center plane, wherein the center plane is parallel to the axis of rotation (R).

15. The adjustment turret (1) according to claim 1, wherein a driver (6) is formed on the adjusting ring (3) and wherein a limiter (7) is formed on the base socket (2); wherein the actuation element (8) is adjustable between the first position and the second position (10, 11) during the rotation of the adjusting ring (3) by means of the relative movement of the driver (6) with respect to the limiter (7).

16. The adjustment turret (1) according to claim 1, wherein the actuation element (8) defines a smallest spacing (38) from the axis of rotation (R) during a respective adjustment into the first position or the second position (10, 11), which is smaller than a smallest distance (39) of the adjusting ring (3) or the base socket (2) from the axis of rotation (R), so that the rotation of the adjusting ring (3) relative to the base socket (2) by means of the actuation element (8) in a current direction of rotation is enabled by the spacing (38), wherein a respective end stop (12, 13) formed is spaced further apart with respect to the axis of rotation (R) than the smallest spacing (39), so that the rotation is blocked during the rotation in the current direction of rotation by the predetermined amount when the end stop (12, 13) is reached.

17. The adjustment turret (1) according to claim 1, wherein at least two complete rotations of the adjusting ring (3) in the first direction of rotation (4) or in the second direction of rotation (5) can be performed between the first end stop (12) and the second end stop (13).

* * * * *